US007029426B1

(12) United States Patent
Fuller, Sr.

(10) Patent No.: US 7,029,426 B1
(45) Date of Patent: Apr. 18, 2006

(54) EXERCISE MACHINE FOR CONDITIONING ATHLETES

(76) Inventor: Barney R. Fuller, Sr., P.O. Box 329, Riverside, TX (US) 77367

( * ) Notice: Subject to any disclaimer, the term of this patent is extended or adjusted under 35 U.S.C. 154(b) by 97 days.

(21) Appl. No.: 10/772,075

(22) Filed: Feb. 3, 2004

Related U.S. Application Data

(60) Provisional application No. 60/444,516, filed on Feb. 3, 2003.

(51) Int. Cl.
*A63B 71/06* (2006.01)

(52) U.S. Cl. ..... 482/97; 482/137; 482/139

(58) Field of Classification Search ..... 482/97, 482/137, 139, 62, 72, 94, 98, 100, 138
See application file for complete search history.

(56) References Cited

U.S. PATENT DOCUMENTS

| | | | | |
|---|---|---|---|---|
| 4,357,010 | A * | 11/1982 | Telle | 482/97 |
| 4,511,137 | A * | 4/1985 | Jones | 482/100 |
| 4,722,522 | A * | 2/1988 | Lundgren | 482/97 |
| 5,058,884 | A * | 10/1991 | Fuller, Sr. | 482/97 |
| 5,637,063 | A * | 6/1997 | Fuller, Sr. | 482/97 |
| 5,941,804 | A * | 8/1999 | Johnston et al. | 482/97 |
| 6,605,024 | B1 * | 8/2003 | Stearns | 482/142 |

* cited by examiner

*Primary Examiner*—Jerome W. Donnelly
(74) *Attorney, Agent, or Firm*—Kenneth A. Roddy

(57) ABSTRACT

An exercise machine has a frame with a generally rectangular base and a platform disposed at an angle at one end upon which the user stands. A horizontal shaft rotatably mounted on a pair of vertical frame members near the forward end of the base has an upper central sprocket at its center and smaller sprockets at its outer ends. A lower central sprocket is rotatably mounted on the base. A weight support arm pivotally connected to a pair of upright frame members extends forwardly therefrom and a selected number of weights are received on the outer end thereof. An elongate lift arm pivotally connected to the vertical frame members extends angularly upward and rearward therefrom toward the platform and has a pair of shoulder pads at its outer end positioned a distance above the platform, with a first and second pair of lateral hand grips near each end of the pads for griping the bar in two positions. A first chain wrapped around the upper central sprocket extends under the lower central sprocket and has its free end connected to the lift arm and a pair of second chains each wrapped around an outer sprocket in the opposite direction have their free ends connected to the weight supporting member. When the lift arm is raised by an upward force on the shoulder pads and/or hand grips, the lift arm pivots upward pulling the first chain down causing rotation of the upper central sprocket and outer sprockets which causes the second chains to pivot the weight supporting member upward with the weights at the outer ends thereof resisting the upward force applied to the lift arm.

7 Claims, 4 Drawing Sheets

EXERCISE MACHINE FOR CONDITIONING ATHLETES

CROSS REFERENCE TO RELATED APPLICATION

This application claims priority of U.S. Provisional Application Ser. No. 60/444,516 iled Feb. 3, 2003.

BACKGROUND OF THE INVENTION

1. Field of the Invention

This invention relates generally to the field of sports conditioning exercise machines, and more particularly to an exercise machine for conditioning athletes to pivot the upper body relative to the lower body by forcefully moving the hips in a roll and drive motion upwardly through a resistive weight load.

2. Background Art

In the sport of football, the most effective way to block an opposing player is to advance toward the opponent while moving horizontally in a crouched position, and upon making contact with the opponent, to exert an explosive force vertically upward on the opponent which tends to lift the opponent off the ground. The player doing the blocking must smoothly and quickly pivot the upper body relative to the lower body by forcefully moving his hips in a roll and drive motion upwardly through the weight load to accomplish the most effective and powerful blocking movement. This explosive movement employs the leg, hip, abdominal, back, arms, shoulder, and chest muscles in one explosive movement, particularly the gluteus, quadricep, and hamstring muscle areas.

A strong athlete is not necessarily a powerful athlete and strength alone will not achieve the best results on the field of play. In blocking actions, the explosive movement requires the athlete to lift a heavy resistive weight over a full range of upward movement at a high rate of speed. While an athlete may acquire strength from lifting weights, powerful blocking technique requires performing multiple sets of repetitions of the desired movement at a predetermined weight load within a predetermined number of seconds.

While there are many devices which teach the art of blocking, none of these devices promotes the mastery of, or conditions the muscles in the manner utilized in the explosive hip roll and drive motions described above. Most of the conventional blocking devices merely train a player to charge towards an object, and provide some resistance to the force exerted by the charging player.

There are several patents which disclose various exercise machines for conditioning and strengthening athletes and other apparatus particularly designed for training football players.

Brentham, U.S. Pat. No. 3,822,599 discloses an exercise device comprising a handle pivotally mounted on a frame with a hydraulic system connected to the handle to exert a regulated force restraining movement of the handle.

Telle, U.S. Pat. No. 4,357,010 discloses an exercise apparatus for developing selected muscles of the body comprising a rigid upright support having a first beam pivoted on a horizontal axis near the top of the support and a second beam similarly pivoted below the first beam. The two beams are connected by a telescopic link to move together. Handles and shoulder pads are provided for lifting the first beam and a weight holding rod on the outer end of the second beam receives a selected number of weights to be lifted. The rate of movement of the beams is maintained substantially constant by a hydraulic cylinder.

Palladino, Jr., U.S. Pat. No. 4,720,103 discloses a training device for football players to train the user in the art of blocking. The apparatus includes a frame which defines an upwardly—sloping track, and a carriage which moves along the track. The carriage is connected by a pulley system to a hydraulic or pneumatic cylinder or the equivalent for imparting resistance to the movement of the carriage along the track.

Lundgren, U.S. Pat. No. 4,722,522 discloses an exercise machine comprising an operating bar which can be moved between operating positions at least 180 degrees apart, and a sprocket on the axis of motion carries a chain connected to a lever for exerting a near constant reaction force or torque. A bellcrank on the same axis carries weights that provide a variable force or torque on the movable bar. The user assumes one position to exercise the biceps and another position to exercise the triceps.

Fuller, Sr., U.S. Pat. No. 5,058,884 is my previous patent for an exercise machine that is particularly useful in developing the ability of an offensive or defensive lineman to smoothly and quickly pivot the upper body upwardly relative to the lower body by forcefully moving his hips in a roll and drive motion through a resistive weight load.

Fuller, Sr., U.S. Pat. No. 5,637,063 is my previous patent for an exercise machine that requires the user to pull, turn, and push, and thus rotate the upper body relative to the lower body while also pivoting the upper body upwardly relative to the lower body by forcefully moving his hips in a roll and drive motion through a resistive weight load.

The present invention is an improvement over my previous patents in that it incorporates structural elements which receive the shoulders of the user and require the user to stand or crouch on an inclined surface while forcefully moving his hips in a roll and drive motion to drive the upper body upwardly through a resistive weight load. The present machine strengthens the all of the muscle groups, and provides maximum loading of the gluteus, quadriceps, and hamstring muscle areas. The present machine also allows certain muscles to be isolated while performing exercises to strengthen the gluteus, quadriceps, and hamstring muscle areas, without stress on the knees and back.

The present invention is distinguished over the prior art in general, and these patents in particular by an exercise machine having a frame with a generally rectangular base and a platform disposed at an angle at the rearward end upon which the athlete stands. A horizontal shaft rotatably mounted on a pair of vertical frame members near the forward end of the base has an upper central sprocket at its center and smaller sprockets at its outer ends. A lower central sprocket is rotatably mounted on the base between the upright frame members. A weight support arm pivotally connected to a pair of upright frame members extends forwardly therefrom and a selected number of weights are received on the outer end thereof. An elongate lift arm pivotally connected to the vertical frame members extends angularly upward and rearward therefrom toward the platform and has a pair of shoulder pads at its outer end positioned a distance above the platform, with a first and second pair of lateral hand grips near each end of the pads for griping the bar in two positions. A first chain wrapped around the upper central sprocket extends under the lower central sprocket and has its free end connected to the lift arm and a pair of second chains each wrapped around an outer sprocket in the opposite direction have their free ends connected to the weight supporting member. When the lift arm is raised by an upward force on the shoulder pads and/or hand grips, the lift arm pivots upward pulling the first chain down causing rotation of the upper central sprocket and outer sprockets which causes the second chains to pivot the weight supporting member upward with the weights at the outer ends thereof resisting the upward force applied to the lift arm.

SUMMARY OF THE INVENTION

It is therefore an object of the present invention to provide a exercise machine which aids a football player in perfecting the art of blocking.

It is another object of this invention to provide an exercise machine which strengthens and conditions the specific muscle groups used in an effective blocking motion.

Another object of this invention is to provide an exercise machine which conditions a football player to smoothly and quickly pivot the upper body relative to the lower body by forcefully moving his hips in an explosive roll and drive motion upwardly through the weight load so as to lift his opponent off the ground.

Another object of this invention is to provide an exercise machine which strengthens and conditions the leg, hip, abdominal, back, arms, shoulder, and chest muscles in one explosive movement.

Another object of this invention is to provide an exercise machine which provides maximum loading of the gluteus, quadricep, and hamstring muscle areas.

A further object of this invention is to provide an exercise machine which allows certain muscles to be isolated while performing exercises to strengthen the gluteus, quadriceps, and hamstring muscle areas, without stress on the knees and back.

A still further object of this invention is to provide an exercise machine which is simple in construction, economical to manufacture, and rugged and reliable in use.

Other objects of the invention will become apparent from time to time throughout the specification and claims as hereinafter related.

The above noted objects and other objects of the invention are accomplished by an exercise machine having a frame with a generally rectangular base and a platform disposed at an angle at the rearward end upon which the athlete stands. A horizontal shaft rotatably mounted on a pair of vertical frame members near the forward end of the base has an upper central sprocket at its center and smaller sprockets at its outer ends. A lower central sprocket is rotatably mounted on the base between the upright frame members. A weight support arm pivotally connected to a pair of upright frame members extends forwardly therefrom and a selected number of weights are received on the outer end thereof. An elongate lift arm pivotally connected to the vertical frame members extends angularly upward and rearward therefrom toward the platform and has a pair of shoulder pads at its outer end positioned a distance above the platform, with a first and second pair of lateral hand grips near each end of the pads for griping the bar in two positions. A first chain wrapped around the upper central sprocket extends under the lower central sprocket and has its free end connected to the lift arm and a pair of second chains each wrapped around an outer sprocket in the opposite direction have their free ends connected to the weight supporting member. When the lift arm is raised by an upward force on the shoulder pads and/or hand grips, the lift arm pivots upward pulling the first chain down causing rotation of the upper central sprocket and outer sprockets which causes the second chains to pivot the weight supporting member upward with the weights at the outer ends thereof resisting the upward force applied to the lift arm.

DESCRIPTION OF THE PREFERRED EMBODIMENT

Figure 1:
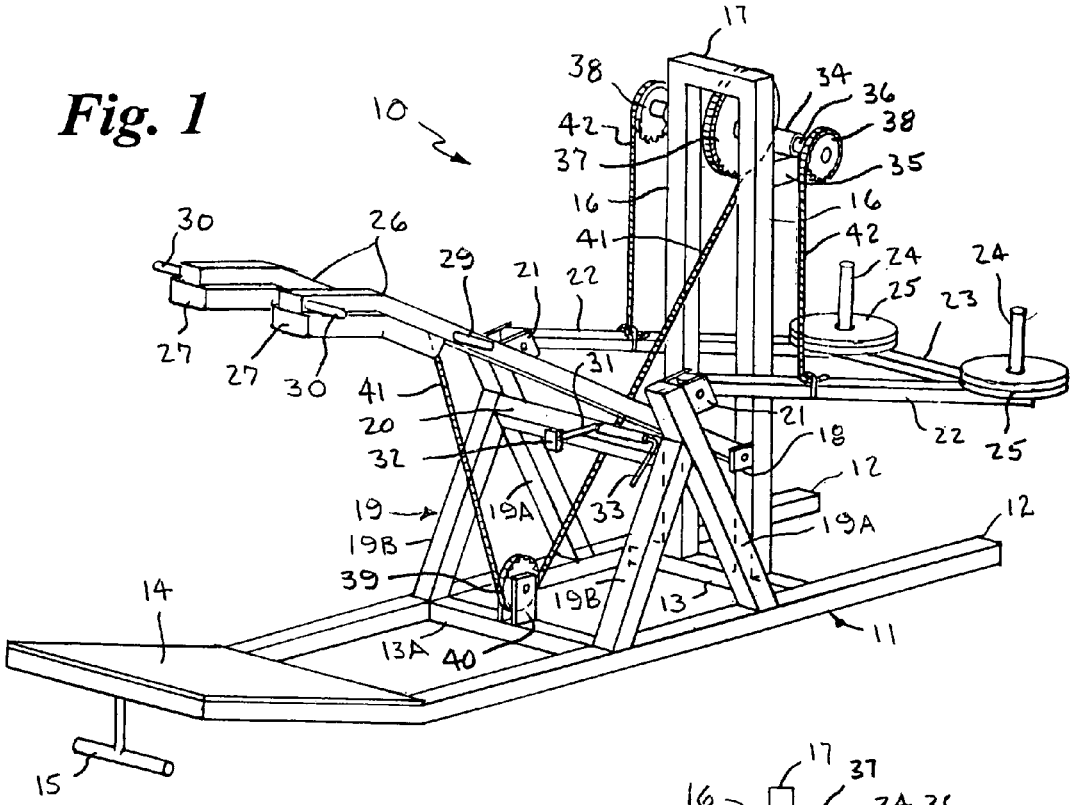
FIG. 1 is a perspective view of the exercise machine for conditioning athletes in accordance with the present invention.
Figure 2:
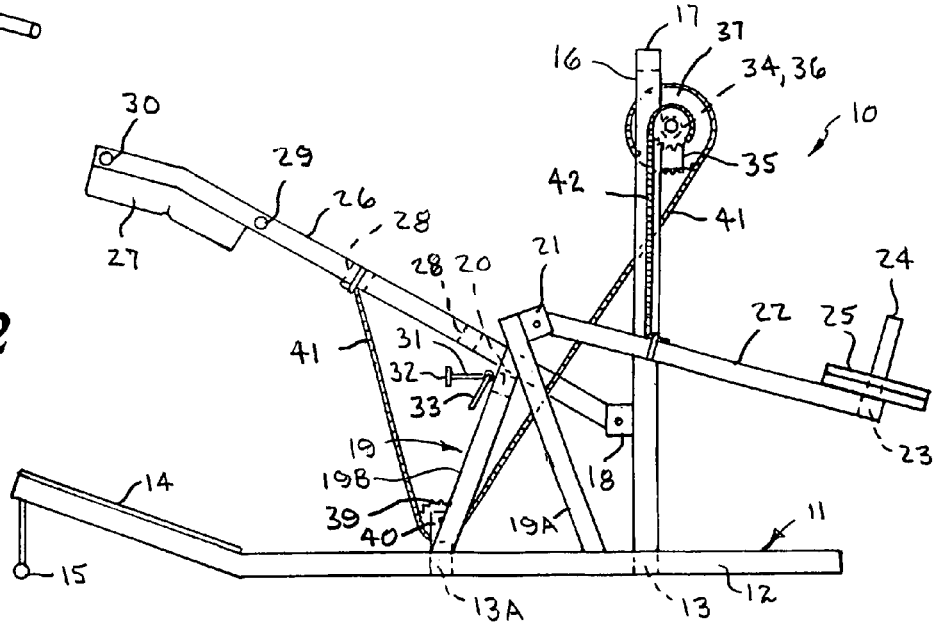
FIG. 2 is a side elevation of the exercise machine.
Figure 3:
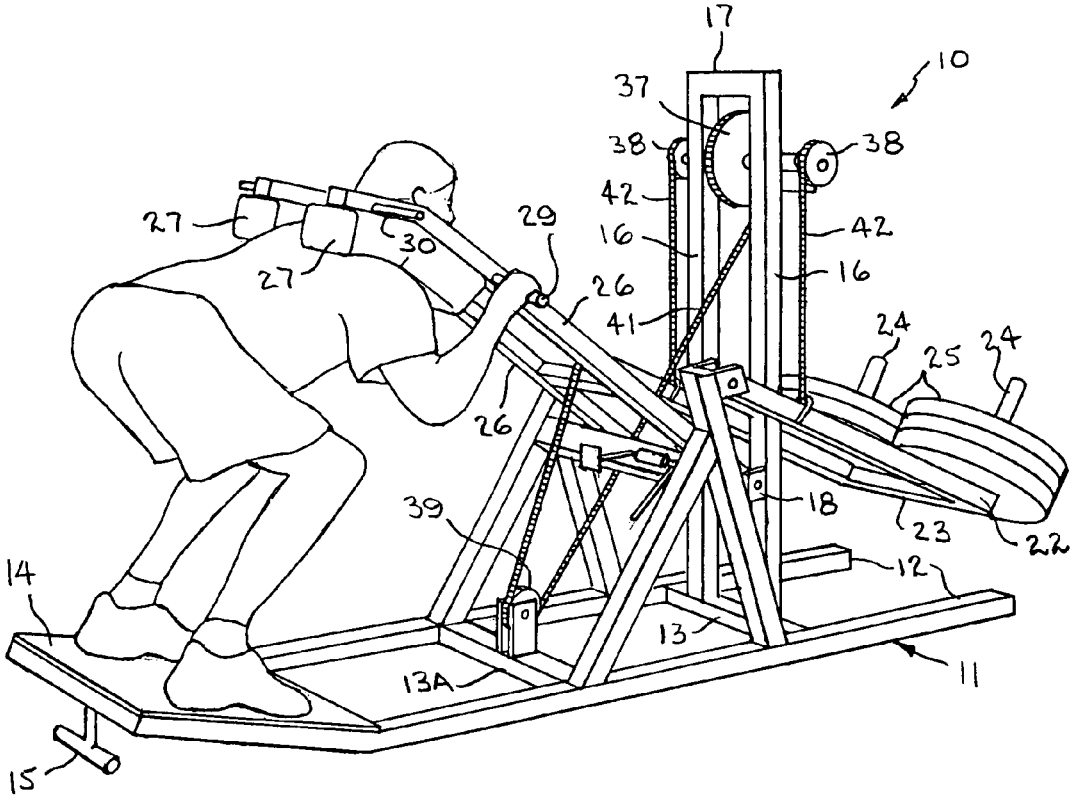
FIG. 3 is a perspective view showing a person using the exercise machine, shown in a crouched position with their shoulders engaged on the shoulder pads and hands gripping the first pair of hand grips the beginning of a hip and roll maneuver.

Referring to the drawings by numerals of reference, there is shown in FIGS. 1, 2, and 3, a preferred exercise machine 10 which develops the ability of an athlete, such as an offensive or defensive lineman, to smoothly and quickly pivot the upper body relative to the lower body by forcefully moving his hips in an explosive angularly upward roll and drive motion through a resistive weight load simulating an effective and powerful blocking movement, and strengthens the gluteus, quadriceps, and hamstring muscle areas.

The exercise machine 10 comprises a frame 11 having a pair of elongate parallel spaced base members 12 of square tubing. One or more cross members 13 are secured transversely between the base members 12 at longitudinally spaced locations. A foot platform 14 of flat plate is secured to the top of the base members 12 at a rearward end to extend transversely therebetween and provide a surface upon which the athlete stands. The rearward end of the base members 12 and foot platform 14 extend rearwardly and upwardly at an angle of about 30° relative to a horizontal axis, and are supported by an inverted generally T-shaped support 15.

A pair of parallel spaced vertical members 16 of square tubing are secured at their bottom ends to a cross member 13 near the end opposite the foot platform 14. The vertical members 16 are spaced laterally inward relative to the base members 12. A horizontal upper cross member 17 is secured transversely between the vertical members 16 at their top ends. A pair of rectangular straps or brackets 18 are secured near the lower ends of the vertical members 16.

A pair of inverted V-shaped upright members 19 of square tubing are secured at their bottom ends, one to each to base member 12, in laterally opposed relation to converge upwardly therefrom. One leg 19A of each upright member 19 is longer than the other leg 19B. A cross member 13A is secured transversely between the base members 12 near the bottom end of the legs 19B of the upright members 19. An upper cross member 20 of square tubing is secured transversely between the upright members 19. A pair of rectangular straps or brackets 21 are secured at the upper ends of the longer legs 19A and extend outwardly therefrom.

A pair of elongate weight arms 22 of square tubing are pivotally mounted at one end in the brackets 21 and extend angularly outward a downward therefrom just outside the vertical members 16. A cross member 23 is secured transversely between the weight arms 22 at their outer ends. A round bar 24 secured to the top surface of the outer ends of each weight arm extends upwardly therefrom to receive weights 25. As described below, the weight arms 22 are pivotally raised and lowered about the horizontal axis of the bracket members 21.

A pair of elongate lift arms 26 formed of square tubing are pivotally connected in the brackets 18 on the vertical members 16 and extend angularly upward and outward therefrom toward the foot platform end (14) and pass over the cross member 20 secured between the upright members 19. A generally rectangular shoulder pad 27 is secured to the underside of the free end of each lift arm 26. The outer end portions of the lift arms 26 and shoulder pads 27 extend rearwardly and downwardly at an angle relative to the longitudinal axis of the lift arms. A cross member 28 is secured transversely between the lift arms 26 intermediate their ends. A round crossbar is secured transversely between the lift arms 26 near the forward ends of the shoulder pads 27. A front pair of padded hand grips 29 and a rear pair of padded hand grips 30 extend laterally outward from the sides of the lift arms 26 near the forward and rearward ends of the shoulder pads 27, respectively.

A generally L-shaped lift arm support bar 31 having a support plate 32 at the end of one leg and a handle 33 at the end of the other leg is pivotally mounted on the cross member 20 and is movable between a generally horizontal lowered position and a generally vertical raised position. When the lift arm support bar 31 is in its lowered position, the lift arms 26 may be supported intermediate their ends on the upper cross member 20 wherein the outer ends of the lift arms 26, shoulder pads 27 and hand grips 29, 30 are disposed at a shorter height above the foot platform 14. When the lift arm support bar 31 is in its generally vertical raised position one of the lift arms 26 or a cross member 28 between the lift arms may be supported on the support plate 32 of the lift arm support bar whereby the outer ends of the lift arms, shoulder pads 27, and hand grips 29, 30 are disposed a greater height above the foot platform 14. Thus, the lift arms 30, shoulder pads 37 and hand grips 29, 30 may be disposed at different heights for different exercises.

A pair of hollow tubular members 34 are secured in horizontal axial alignment, one to each vertical member 16 near their upper ends, and a pair of square tubular members 35 are secured to the vertical members 16 and to the horizontal tubular members 34 for support. A shaft 36 is rotatably mounted through the hollow tubular members 34 and extends outwardly to each side thereof. A larger sprocket 37 is mounted at the center of the shaft 36 and a pair of smaller sprockets 38 are mounted one on each outer end of the shaft. A third smaller sprocket 39 is rotatably mounted in a bracket 40 secured to the cross member 13A between the base members 12.

A chain 41 secured at one end to the larger sprocket 37 is wrapped around a segment thereof, passes in engagement under a segment of the third smaller sprocket 39, and its other end is connected to the cross member 28 between the lift arms 26. A pair of chains 42 are each secured at one end to a respective smaller sprocket 38, wrapped around a segment thereof, and connected at their other ends to a respective one of the weight arms 22. The chains 41 and 42 are wrapped in opposite directions around the sprockets 37 and 38, respectively.

When the lift arms 26 are raised by an upward force on the shoulder pads 27 and/or hand grips 29, 30, the lift arms will pivot upward pulling the end of the chain 41 connected thereto upward and the other end of the chain down and thereby rotate the larger sprocket 37. Rotation of the sprocket 37 rotates the shaft 36 and the smaller sprockets 38 at its ends causing the ends of chains 42 to pull upward on the weight arms 22 pivoting them upward about the axis of the bracket 21. Resistance to the upward force applied to the lift arms 26 is determined by the weights 25 installed on the round bars 24 at the outer ends of the weight arms 22.

OPERATION

In one example, called a "Hip and Roll Separation" exercise, the lift arm support bar 31 is moved to the lowered position wherein the lift arms 26 and shoulder pads 27 are disposed at a shorter height above the foot platform 14, and the proper number of weights 25 are placed on the rods 24. The athlete stands on the platform 14 and lowers his hips to assume a crouched position with his shoulders engaged the shoulder pads 27 and grasps the front pair of hand grips 29 (FIG. 3).

Figure 4:
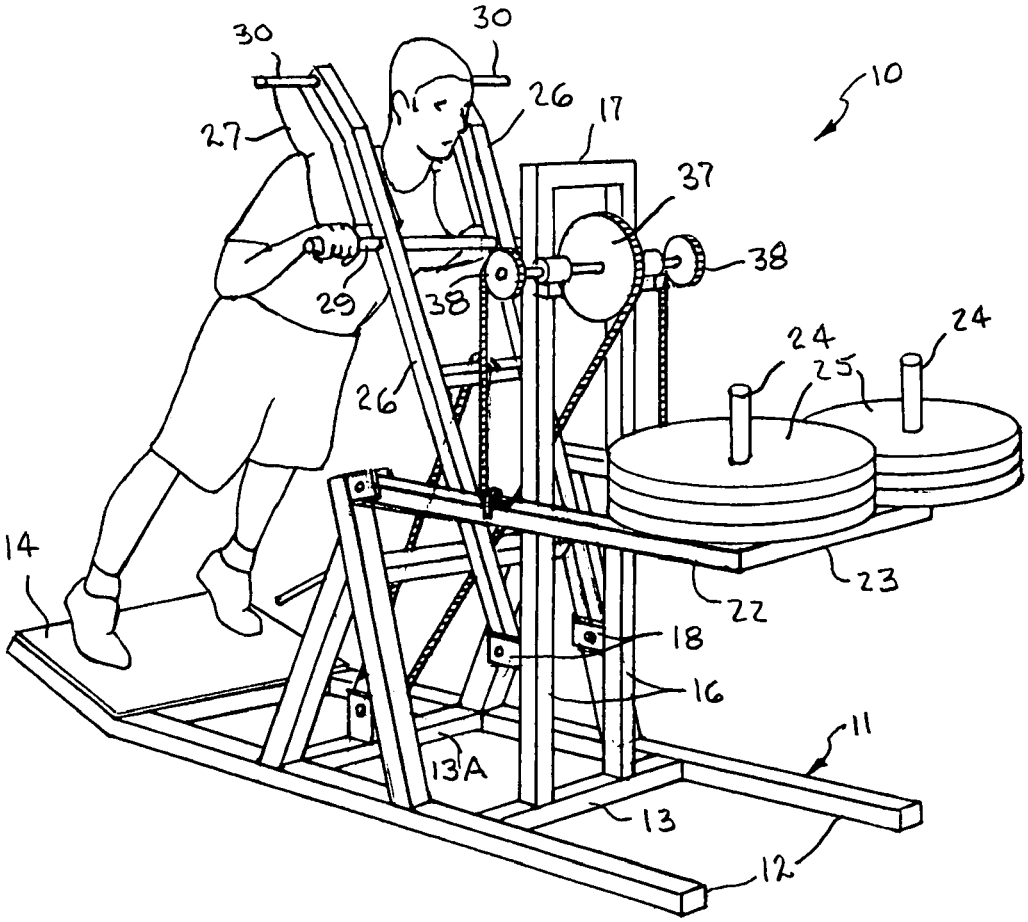
FIG. 4 is a perspective view showing a person using the exercise machine, shown at the completion of the hip and roll maneuver with their body extended and shoulders engaged on the shoulder pads and hands gripping the first pair of hand grips.

The movement is initiated with the hips. In one smooth movement, the hips are forcefully and quickly rolled forward bringing the upper body upward against the weight load and finishing the movement standing on the balls of his or her feet (FIG. 4), which raises the lift arms 26 against the resistive weight load. In this movement, the lower body and particularly the hips and legs initially activate the weight load and finish out the explosive lifting of the weight load at fast speed. This motion involves all the major muscle groups in the body. All the muscles of the legs, hips, lower back, lower abdominal, upper abdominal, chest, upper back, shoulders, and arms are activated together through one simultaneous explosive movement. This exercise strengthens and provides maximum loading of the gluteus and quadriceps muscle areas, and conditions the athlete in the proper recoil action (firing) of the hips into the weight load in a game playing position.

Figure 5:
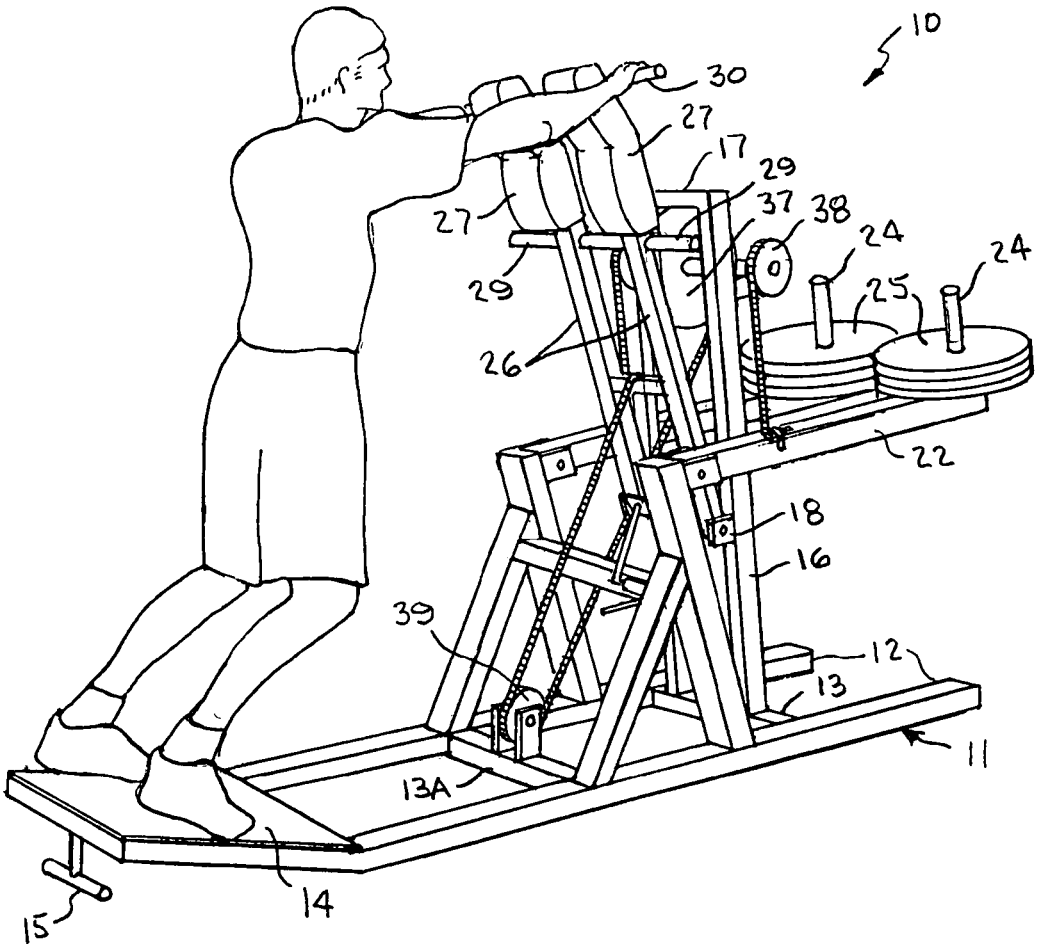
FIG. 5 is a perspective view showing a person using the exercise machine, shown in a position at the completion of a hip and roll hand separation maneuver with their body extended and hands gripping the second pair of hand grips.

In another example, called a "Hand Separation" exercise, the lift arm support bar 31 is moved to the raised position wherein the lift arms 26, shoulder pads 27, and hand grips 29, 30 are disposed at a greater height above the foot platform 14, and the proper number of weights 25 are placed on the rods 24. The athlete stands on the platform 14 and lowers his hips to assume a crouched position and grasps the rear pair of hand grips 30 (FIG. 5), or in some exercises, the front pair of hand grips.

The movement is initiated with the hips. In one smooth movement, the hips are forcefully and quickly rolled forward bringing the upper body upward against the weight load and finishing the movement with a full extension of the arms, which raises the lift arms against the resistive weight load. In this movement, the lower body and particularly the hips initially activate the weight load and the upper body finishes out the explosive lifting of the weight load. This motion also involves all the major muscle groups in the body. All the muscles of the legs, hips, lower back, lower abdominal, upper abdominal, chest, upper back, shoulders, and arms are activated together through one simultaneous explosive movement. This maneuver conditions the athlete to explode the hips into the weight load and trains them in the proper hand separation in a game playing blocking movement.

In still another example, called a "Hack Squat" exercise, the lift arm support bar 31 is moved to the lowered position wherein the lift arms 26, shoulder pads 27, and hand grips 29, 30 are disposed at a shorter height above the foot platform 14, and the proper number of weights 25 are placed on the rods 24. The athlete stands on the inclined platform 14 facing away from the machine and lowers his hips to assume a squatting position with his or her head in the space between the shoulder pads 27 and shoulders engaged the shoulder pads and grasps the rear pair of hand grips 30.

In one smooth movement, the legs are straightened to forcefully and quickly bringing the upper body upward and rearward against the weight load and finishing the movement in a standing position, which raises the lift arms 26 against the resistive weight load. In this movement, the lower body and particularly the hips and legs initially activate the weight load and finish out the explosive lifting of the weight load at fast speed. This motion isolates and strengthens gluteus and hamstring muscle areas without stress on the knees and back.

A set of eight to twelve repetitions is recommended and should be accomplished in approximately fifteen seconds. Different muscle fibers are affected by a quick movement than by a slow movement. Moving through the explosive maneuver rapidly develops and conditions the white, or "fast twitch" muscle fibers. Red, or "slow twitch" muscle fibers are used in slow movements such as in simple weight lifting exercises. Power is developed by quickness in overcoming an increasing weight load. In other words, if it lakes one person a minute to move weight a certain distance and another person can do it in three seconds, he is said to have more power.

Power, rather than strength alone, is what will achieve the best results on the field of play. In blocking actions, the explosive movement requires the athlete to lift a heavy resistive weight over a full range of upward movement at a high rate of speed. While an athlete may acquire strength from lifting weights, powerful blocking technique requires performing multiple sets of repetitions of the desired movement at a predetermined weight load within a predetermined number of seconds. The present exercise machine will condition an athlete to be quick, powerful, and explosive. The present exercise machine can also be used in performing shoulder press and bench press exercises.

While this invention has been described fully and completely with special emphasis upon a preferred embodiment, it should be understood that within the scope of the appended claims the invention may be practiced otherwise than as specifically described herein.

I claim:

1. An exercise machine for conditioning athletes, comprising:

a frame having a generally rectangular base portion for supporting the frame on a flat surface and having forward and rearward ends, an inclined platform at the rearward end of the base portion upon which a user may stand, a pair of parallel laterally spaced vertical members near the forward end of said base portion, and a pair of laterally spaced upright members on the base portion between the foot platform and the vertical members;

a weight arm pivotally mounted at one end to said upright members on a horizontal axis and extending forwardly therefrom and having weight receiving means at its outer end for receiving a selected number of weights to be lifted;

an elongate lift arm pivotally mounted at one end to said vertical members on a horizontal axis and extending angularly upward and outward therefrom toward said platform, laterally spaced shoulder pads on an outer end portion thereof, and laterally spaced hand grip means on said outer end portion adjacent to said shoulder pads, said outer end portion being positionable at selective distances above said platform;

a horizontal shaft rotatably mounted at an upper end of said vertical members and extending outwardly to each side thereof, an upper central sprocket secured at the center of said shaft and a pair of second sprockets secured one on each outer end of said shaft;

a lower central sprocket rotatably mounted on said frame adjacent to a lower end of said laterally spaced upright members;

a first chain secured at a first end on said upper central sprocket and wrapped around a segment thereof and a segment of said lower central sprocket and secured at a second end to said lift arm;

a pair of second chains each secured at a first end to a respective one of said second sprockets and wrapped around a segment thereof and secured at a second end to said weight arm;

said first chain and said second chains being wrapped in opposite directions around said upper central sprocket and said second sprockets, respectively; and said lift arm when pivoted upward by an upward force on its said outer end portion pulls said first chain to cause rotation of said upper central sprocket and said horizontal shaft and said second sprockets at its outer ends to simultaneously cause said second chains to pull upward on said weight arm to pivot it upward with the weights at the outer ends thereof resisting the upward force applied to said outer end portion of said lift arm.

2. The exercise machine according to claim 1, further comprising:

positioning means on said frame for selectively positioning said lift arm outer end portion at selective distances above said platform; whereby the user may assume a crouched position on said platform and grip said hand grip means and apply an upward force on said lift arm by quickly rolling his or her hips forward and bringing the upper body upward against the resistive weight load and finishing the movement with a full extension of the arms; or the user may assume a crouched position on said platform and engage their shoulders on said shoulder pads and grip said hand grip means and apply an upward force on said lift arm by quickly rolling his or her hips forward and bringing the upper body upward against the resistive weight load and finishing the movement with a full extension of the body.

3. The exercise machine according to claim 1, wherein said hand grip means comprises a first pair of laterally disposed hand grips adjacent to a first end of said shoulder pads, and a second pair of laterally disposed hand grips adjacent to a second end of said shoulder pads to provide two different positions.

4. The exercise machine according to claim 1, wherein said frame base portion comprises a pair of elongate parallel spaced tubular base members with longitudinally spaced cross members secured transversely therebetween, said tubular base members having an angular upwardly inclined end portion, and said platform is a flat plate secured to the top of said upwardly inclined end portion of said base members to extend transversely therebetween;

said vertical members comprise a pair of parallel spaced vertical tubular members secured at their bottom ends to a said cross member near the end opposite said foot platform and positioned laterally inward relative to said base members and joined at their upper ends by a horizontal cross member secured transversely therebetween;

said upright members are secured at their bottom ends one to each said base member in laterally opposed relation to extend upwardly therefrom and joined at their upper ends by a horizontal cross member secured transversely therebetween; and said weight arm comprises a pair of parallel elongate tubular weight arms each pivotally mounted at one end to the upper end of a respective one of said upright members and extending outwardly therefrom laterally spaced at each side of said vertical members and joined at their outer ends by a cross member secured transversely therebetween.

5. The exercise machine according to claim 4, wherein said lower central sprocket is rotatably mounted on a said longitudinally spaced cross members secured transversely between said tubular base members adjacent to a lower end of said laterally spaced upright members.

6. The exercise machine according to claim 4, wherein said upright members comprise a pair of inverted V-shaped tubular members secured at their bottom ends one to each base member to converge upwardly therefrom.

7. The exercise machine according to claim 4, wherein said lift arm pivot arm comprises a pair of parallel elongate tubular lift arms each pivotally mounted near a lower end of a respective one of said vertical members and joined together by a cross member secured transversely therebetween.

* * * * *